US005902227A

United States Patent [19]

Rivas

[11] Patent Number: 5,902,227

[45] Date of Patent: May 11, 1999

[54] MULTIPLE EMULSION AND METHOD FOR PREPARING SAME

[75] Inventor: Hercilio Rivas, Caracas, Venezuela

[73] Assignee: Intevep, S.A., Caracas, Venezuela

[21] Appl. No.: 08/895,793

[22] Filed: Jul. 17, 1997

[51] Int. Cl.[6] ..... B01J 13/00; C10L 1/32

[52] U.S. Cl. ..... 516/54; 44/301; 516/52

[58] Field of Search ..... 252/312, 314, 252/311.5; 44/301; 516/52, 54

[56] References Cited

U.S. PATENT DOCUMENTS 3,540,866 11/1970 Miller ..... 44/301
3,749,318 7/1973 Cottell ..... 431/4
4,804,495 2/1989 Bouchez et al. ..... 252/312
5,505,877 4/1996 Krivohlavek ..... 252/314
5,603,864 2/1997 Silva et al. ..... 252/312 X

*Primary Examiner*—Richard D. Lovering
*Attorney, Agent, or Firm*—Bachman & LaPointe, P.C.

[57] ABSTRACT

A multiple emulsion includes a continuous water phase; an oil droplet phase dispersed through the continuous water phase; an inner water droplet phase dispersed through the oil droplet phase; and a water insoluble compound suspended in the inner water droplet phase. The multiple emulsion is useful as a transportable and combustible fuel.

26 Claims, 1 Drawing Sheet

MULTIPLE EMULSION AND METHOD FOR PREPARING SAME

BACKGROUND OF THE INVENTION

The present invention relates to multiple emulsions and a method for preparing same, especially with respect to multiple emulsions useful as a transportable and combustible fuel.

In the field of emulsions, there are numerous disclosures related to two-phase emulsions, that is, water-in-oil (W/O) emulsions and oil-in-water (O/W) emulsions. Multiple emulsions, that is emulsions having more than two phases, are discussed in connection with various fields in U.S. Pat. Nos. 5,478,561, 5,438,041 and 4,254,105, and in connection with fuels in U.S. Pat. No. 5,505,877.

The specific composition of emulsions is very important in the fuel industry, and numerous characteristics, additives and the like affect the stability of the emulsion, and therefore its usefulness as a transportable and combustible fuel. Further, depending upon the oil or hydrocarbon used in the emulsion, various contaminants may be present, and additives to counteract such contaminants may affect the stability of the emulsion.

The need remains for a stable multiple emulsion which can be formed using reduced amounts of expensive components such as surfactant and other additives.

Furthermore, the need remains for a multiple emulsion wherein the corrosive nature of metals such as vanadium and the like which may typically be contained in the oil phase are effectively and economically counteracted, without disrupting stability of the emulsion.

In light of the foregoing, it is the primary object of the present invention to provide a stable multiple emulsion which is formed using minimal amounts of surfactant.

It is a further object of the present invention to provide a stable multiple emulsion which includes additives for counteracting the corrosive nature of metals contained in the oil phase.

It is another object of the present invention to provide a multiple emulsion which is readily transported and combusted as a useful and desirable fuel product.

Other objects and advantages of the present invention will appear hereinbelow.

SUMMARY OF THE INVENTION

In accordance with the present invention, the foregoing objects and advantages are readily attained.

According to the invention, a multiple emulsion is provided, which comprises: a continuous water phase; an oil droplet phase dispersed through the continuous water phase; an inner water droplet phase dispersed through the oil droplet phase; and a water insoluble compound suspended in the inner water droplet phase.

In further accordance with the invention, a method for forming a multiple emulsion in accordance with the invention is provided, which method comprises the steps of: providing a suspension of a water insoluble compound in water; providing an oil phase; forming a water-in-oil emulsion of the suspension in the oil phase; providing a water phase; and forming an emulsion of the water-in-oil emulsion in the water phase in the presence of a surfactant.

BRIEF DESCRIPTION OF THE DRAWINGS

A detailed description of preferred embodiments of the present invention follows, with reference to the attached drawings, wherein.

DETAILED DESCRIPTION

The invention relates to multiple emulsions, specifically water-in-bitumen-in-water emulsions which are useful as a transportable and combustible fuel, and to a method for preparing same.

Figure 1:
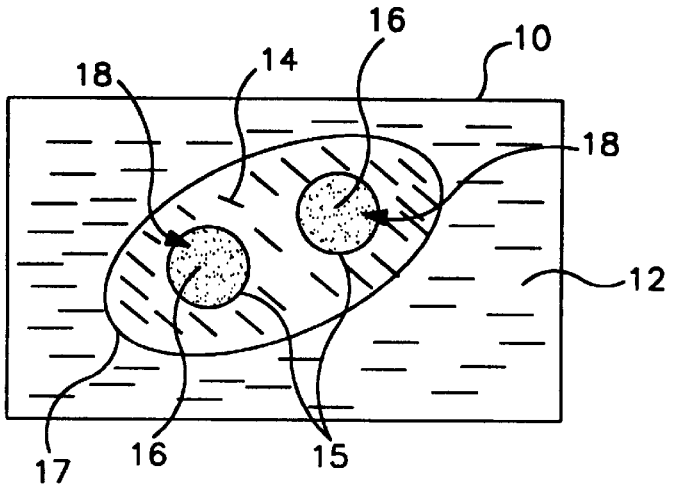
FIG. 1 schematically illustrates a multiple emulsion in accordance with the present invention.

Referring to FIG. 1, a schematic illustration of a multiple emulsion system in accordance with the present invention is provided. As shown, emulsion system 10 includes a continuous water phase 12, an oil or hydrocarbon phase dispersed through the continuous water phase 12 and illustrated in FIG. 1 as a single oil droplet 14, and an inner water droplet phase dispersed through the oil droplets 14 as shown in FIG. 1 by water droplets 16. In accordance with the present invention, water droplets 16 are a suspension or slurry of water insoluble compound represented by particles 18 which, as will be discussed below, are economically incorporated into the multiple emulsion of the present invention and which advantageously serve to counteract undesirable side effects, during combustion, of other materials typically found within the oil phase of the emulsion without adversely affecting stability of the emulsion.

Figure 2:
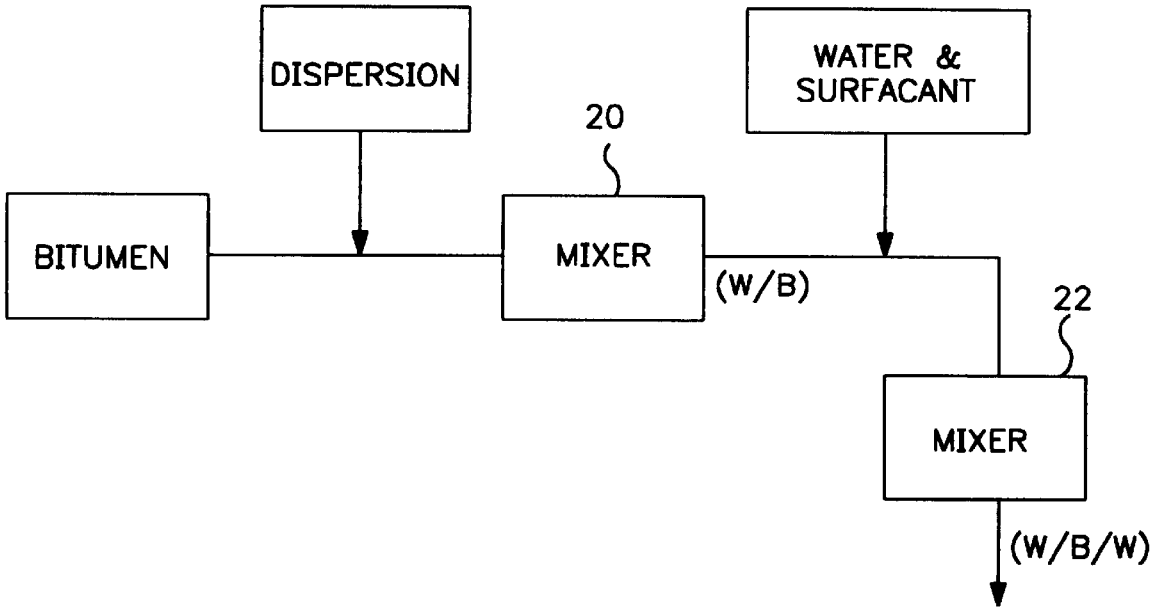
FIG. 2 schematically illustrates a method for forming a multiple emulsion in accordance with the present invention.

Viscous hydrocarbons can be formed into emulsions such as the emulsion of the present invention so as to provide enhanced transportation and pumpability thereby facilitating use of the viscous hydrocarbon as a combustible fuel. In preparation of such emulsions, however, surfactants are typically needed so as to provide stability of the emulsion and to prevent rapid aging of same. Furthermore, viscous hydrocarbons may include a number of different components such as metals, particularly vanadium, which are corrosive or cause other complications during combustion of the fuel. In accordance with the present invention, a multiple emulsion as illustrated in FIG. 1, and a method for preparation of such an emulsion as illustrated in FIG. 2, are provided which advantageously reduce the amount of surfactant needed in formation of the emulsion, and which further allow for reduction of undesirable affects of metals such as vanadium in an economical manner and without destabilizing the emulsion.

The oil droplet phase of the multiple emulsion of the present invention may suitably be any desired oil or hydrocarbon phase. Viscous hydrocarbons, however, are particularly well suited to taking advantage of the beneficial characteristics of the present invention. Preferred viscous hydrocarbons include crude oil or bitumens which are characterized by a viscosity of greater than or equal to about 100 cp at 122° F., which have an API gravity of 16 or less, which are characterized by a high metal content, typically at least about 1000 ppm (wt), a high sulfur content and a high asphaltene content, and which typically have a high pour point. A specific example of a suitable viscous hydrocarbon for use in accordance with the present invention is Cerro Negro bitumen. This bitumen contains considerable amounts of vanadium compounds, greater than or equal to about 700 ppm (wt), which typically cause corrosion problems and metallic slag formation when burned as a fuel. This type of bitumen is incorporated into an emulsion sold under the trademark Orimulsion® by Bitor, S.A. In this two-phase emulsion, magnesium nitrate, a water soluble compound, is added to combat the adverse affects of vanadium. However, magnesium nitrate has been found to promote the growth of bacterias and the like naturally present in the bitumen which in turn have been found to cause destabilization of the emulsion.

In accordance with the present invention, a water insoluble compound, most preferably an insoluble magnesium or calcium compound such as a carbonate, hydroxide, oxide or phosphate of magnesium, calcium or both, are included in the multiple emulsion so as to combat the adverse affects of vanadium, but in a form which does not stimulate the growth of bacteria and resulting destabilization of the emulsion.

Magnesium or calcium oxide are particularly preferred as insoluble compositions for addition to the multiple emulsion of the present invention as they are effective in counteracting vanadium, and are also in abundant supply.

The multiple emulsion in accordance with the present invention preferably has an average droplet size of oil droplets 14 of between about 10 microns and about 30 microns, and also preferably has an average droplet size of inner water phase droplets 16 of between about 2 microns and about 6 microns. The water insoluble compound 18 is substantially entirely located within inner water droplets 16.

The multiple emulsion of the present invention preferably has a ratio of bitumen to total water in the emulsion of between about 90/10 and about 50/50, most preferably about 70/30 vol/vol. Further, water in the inner water droplet phase 16 preferably constitutes less than or equal to about 2% vol. of the total emulsion, while water in the continuous phase 12 preferably constitutes less than or equal to about 28% vol. of the total emulsion.

The multiple emulsion of the present invention preferably contains water insoluble compound, substantially entirely within the inner water droplet phase, in an amount less than or equal to about 500 ppm (wt) based upon the total emulsion, and more preferably contains between about 100 ppm and about 350 ppm (wt). Insoluble compound 18 is preferably provided having an average particle size of between about 0.01 micron and about 1 micron.

As will be discussed below, the multiple emulsion of the present invention is preferably formed using a surfactant only during the stage where oil droplets 14 are dispersed through the continuous water phase 12. Thus, the resulting multiple emulsion of the present invention is substantially free of added surfactant in the portion of the emulsion constituting the inner water phase droplets 16 dispersed through oil phase droplets 14, particularly at the interface 15 between the inner water droplet phase and the oil phase, while the added surfactant is present substantially only in the portion in the emulsion constituting the interface 17 between the continuous water phase 12 and oil droplet phase 14.

Referring now to FIG. 2, the method according to the present invention for forming a multiple emulsion will be described. Initially, a suspension or slurry is provided of the desired water insoluble compound in water. This suspension can be formed through a simple mixing of the water insoluble compound in water in the desired concentration. In this regard, water insoluble compound is preferably mixed with the water so as to form the suspension containing water and insoluble compound in an amount less than or equal to about 12% (wt), preferably between about 1% to about 9% (wt) based on the suspension.

An oil phase is also provided, preferably a viscous hydrocarbon such as a bitumen and the like, as discussed above. The bitumen is then mixed with the suspension and passed to a mixer 20 where the mixture is subjected to mixing for sufficient time and at a sufficient rate to obtain an emulsion of the suspension in the oil, preferably having a ratio by volume of oil/suspension of between about 90/10 and about 98/2. The bitumen may be heated before mixing, if desired, so as to enhance the flowability of same. The suspension and bitumen may be mixed, for example at a mixing speed in the range of between about 1000 rpm and about 5000 rpm, and for a time of between about 1 minute and about 3 minutes so as to provide the suspension in bitumen emulsion preferably having an average water suspension droplet size preferably between about 2 microns and about 6 microns. The water insoluble compound is substantially entirely within the water suspension phase.

A mixture of water and surfactant is then preferably added to the suspension-in-bitumen emulsion and subjected to sufficient mixing over time so as to provide a multiple emulsion having droplets of the suspension-in-bitumen emulsion dispersed throughout a water continuous phase. This mixing step may suitably be carried out at a mixer 22 and provides the desired final multiple emulsion preferably having an average droplet size of the suspension-in-bitumen emulsion in the range of between about 10 microns and about 30 microns. This step is preferably carried out by initially mixing sufficient water and surfactant to provide the multiple emulsion with a ratio of bitumen/water of about 85/15 vol/vol, and then diluting the multiple emulsion to the final desired ratio, for example a ratio of bitumen/water of about 70/30.

The surfactants to be used in the final mixing stage as described above may suitably be selected from the group consisting of non-ionic surfactants such as ethoxylated alkyl phenols, ethoxylated alcohols, nonyl phenol ethoxylates and ethoxylated sorbitan esters, as well as natural surfactants, mixtures of natural and non-ionic surfactants, and anionic surfactants such as sulfates, sulphonates and carboxylates. Particularly preferred as surfactants for this stage are non-ionic surfactants such as ethoxylated tridecanol, natural surfactants activated by amines such as monoethanolamine, and mixtures thereof. In accordance with the invention, the surfactant is preferably provided in amounts by weight of between about 500 ppm and about 4000 ppm and more preferably between about 1000 and about 3000 ppm based on the bitumen.

As set forth above, water is preferably used in the method for preparing the multiple emulsion in amounts contained in the suspension and the water/surfactant mixture so as to provide a final ratio by volume in the multiple emulsion of bitumen/water of between about 90/10 and about 50/50, most preferably about 70/30. Furthermore, water is preferably present in the multiple emulsion in the inner water droplet or suspension phase in an amount of less than or equal to about 2% volume, and in the water continuous phase in an amount of less than or equal to about 28% volume, both with respect to the total emulsion.

The emulsions formed according to the present invention contain suspension-in-bitumen droplets which are big enough to maintain the suspension droplet inside, and which are nevertheless sufficiently small to provide for efficiency in burning.

The multiple emulsion as described above has been found to possess excellent stability and desirable fluid characteristics in terms of transportability and combustion. Furthermore, the emulsion is formed using relatively small amounts of surfactant, and water insoluble magnesium and calcium compounds in the inner water droplet phase have been found to significantly reduce the adverse affects of vanadium and the like typically found in bitumen, while avoiding the high cost, emulsion instability and other problems associated with the use of water soluble compounds.

The following examples further illustrate the preparation and advantageous characteristics of multiple emulsions in accordance with the present invention.

EXAMPLE 1

This example demonstrates the stability in terms of droplet diameter (D) and viscosity (at 20 1/s and 100 1/s) of multiple emulsions prepared using varying amounts of magnesium oxide and different types of surfactants.

A number of multiple emulsions were prepared starting with a suspension of magnesium oxide in water in varying concentrations. 980 grams of Cerro Negro bitumen were heated at 60° C. in a suitable container for 1 hour, and 20 ml of the magnesium oxide suspension were added and mixed for 3 minutes at 1400 rpm so as to provide a suspension-in-bitumen emulsion. In the meantime, 0.98 grams of a surfactant were dissolved in 45.88 grams of water, and the surfactant/water mixture was added to the suspension-in-bitumen emulsion and mixed for 3 minutes at 700 rpm to obtain a multiple emulsion having a ratio by volume of bitumen/water of 85/15. To this 85/15 emulsion, 74.12 additional grams of water were added and mixed at low shear for an additional minute so as to provide the final 70/30 multiple emulsion in accordance with the invention, with about 28% vol. of water in the continuous phase and about 2% vol. of water in the internal water droplet phase.

Several different surfactants were used in this example. Samples were run using a mixture of ethoxylated tridecanol and monoethanolamine for each of 0 ppm, 100 ppm and 350 ppm (wt) of magnesium oxide, and samples were also run using only monoethanolamine as surfactant for each of 0 ppm, 100 ppm and 350 ppm (wt) magnesium oxide.

Storage characteristics for the emulsions prepared using the mixture of ethoxylated tridecanol and monoethanolamine are set forth below in Table 1. The viscosities for each measurement in these examples were measured at 30° C. using a Haake RV 20 viscosimeter with concentric cylinders of MC-1 type.

TABLE 1

| storage | Viscosity (20 1/s) mPa | | | Viscosity (100 1/s) mPa | | | D μm | | |
|---|---|---|---|---|---|---|---|---|---|
| time (days) | 0* (ppm) | 100 (ppm) | 350 (ppm) | 0 (ppm) | 100 (ppm) | 350 (ppm) | 0 (ppm) | 100 (ppm) | 350 (ppm) |
| 1 | 844 | 862 | 821 | 514 | 341 | 685 | 14.1 | 15.9 | 15.1 |
| 5 | 838 | 830 | 780 | 526 | 474 | 447 | 14.5 | 14.4 | 15.5 |
| 10 | 965 | 823 | 889 | 587 | 517 | 501 | 15.3 | 16.1 | 15.5 |
| 20 | 934 | 804 | 821 | 585 | 480 | 482 | 14.8 | 16 | 15.6 |
| 27 | 1046 | 911 | 864 | 603 | 506 | 528 | 15.6 | 15.8 | 16.1 |
| 35 | 1065 | 886 | 886 | 679 | 489 | 532 | 15.5 | 16 | 16 |
| 50 | 970 | 864 | 961 | 611 | 495 | 586 | 16.6 | 16.1 | 16.1 |

*magnesium oxide

Storage results are shown for the emulsions prepared only monoethanolamine in Table 2.

TABLE 2

| storage | Viscosity (20 1/s) mPa | | | Viscosity (100 1/s) mPa | | | D μm | | |
|---|---|---|---|---|---|---|---|---|---|
| time (days) | 0* (ppm) | 100 (ppm) | 350 (ppm) | 0 (ppm) | 100 (ppm) | 350 (ppm) | 0 (ppm) | 100 (ppm) | 350 (ppm) |
| 1 | 849 | 892 | 789 | 423 | 493 | 359 | 14.1 | 15.1 | 14.8 |
| 5 | 834 | 866 | 765 | 484 | 527 | 367 | 14.5 | 15.1 | 15.1 |
| 10 | 756 | 816 | 710 | 379 | 456 | 349 | 13.4 | 15.5 | 14 |
| 20 | 726 | 742 | 758 | 367 | 376 | 358 | 14.5 | 15.5 | 15 |
| 27 | 954 | 828 | 867 | 461 | 435 | 405 | 14.7 | 15.2 | 14.7 |
| 35 | 920 | 742 | 990 | 471 | 412 | 539 | 14.5 | 15.7 | 15.6 |
| 50 | 932 | 871 | 989 | 485 | 476 | 550 | 15 | 15.5 | 16.6 |

*magnesium oxide

As shown, multiple emulsions prepared in accordance with the present invention using magnesium oxide as water insoluble compound, and using different surfactants, show excellent stability.

EXAMPLE 2

This example demonstrates preparation and characteristics of emulsions prepared in accordance with the invention using calcium oxide as water insoluble compound. Multiple emulsions were prepared using the same procedure as set forth in Example 1 at 0 ppm, 100 ppm and 350 (wt) ppm of calcium oxide for a mixture of monoethanolamine and ethoxylated tridecanol surfactants, and for monoethanolamine alone as surfactant. Table 3 below sets forth storage characteristics of the emulsions prepared using the mixture of monoethanolamine and ethoxylated tridecanol as surfactant.

TABLE 3

| storage | Viscosity (20 1/s) mPa | | | Viscosity (100 1/s) mPa | | | D μm | | |
|---|---|---|---|---|---|---|---|---|---|
| time (days) | 0* (ppm) | 100 (ppm) | 350 (ppm) | 0 (ppm) | 100 (ppm) | 350 (ppm) | 0 (ppm) | 100 (ppm) | 350 (ppm) |
| 1 | 844 | 856 | 812 | 514 | 841 | 785 | 14.1 | 15.7 | 15.1 |
| 5 | 838 | 812 | 789 | 526 | 774 | 847 | 14.5 | 15.4 | 15.8 |
| 10 | 965 | 832 | 889 | 587 | 717 | 701 | 15.3 | 15.1 | 15.5 |
| 20 | 934 | 827 | 867 | 585 | 840 | 782 | 14.8 | 15 | 15.3 |
| 27 | 1046 | 911 | 873 | 603 | 860 | 813 | 15.6 | 15.8 | 46.1 |
| 35 | 1065 | 902 | 868 | 679 | 789 | 779 | 15.5 | 16 | 16.3 |
| 50 | 970 | 864 | 861 | 611 | 796 | 786 | 16.6 | 16.2 | 16.1 |

*calcium oxide

Table 4 sets forth storage characteristics for the emulsions prepared using only monoethanolamine as surfactant.

TABLE 4

| storage | Viscosity (20 1/s) mPa | | | Viscosity (100 1/s) mPa | | | D μm | | |
|---|---|---|---|---|---|---|---|---|---|
| time (days) | 0* (ppm) | 100 (ppm) | 350 (ppm) | 0 (ppm) | 100 (ppm) | 350 (ppm) | 0 (ppm) | 100 (ppm) | 350 (ppm) |
| 1 | 849 | 896 | 812 | 423 | 814 | 639 | 15.1 | 15.4 | 14.8 |
| 5 | 834 | 876 | 801 | 484 | 834 | 667 | 14.5 | 15.1 | 15.1 |
| 10 | 756 | 852 | 710 | 379 | 769 | 649 | 13.4 | 15.3 | 15.6 |
| 20 | 726 | 842 | 758 | 367 | 726 | 623 | 14.5 | 15.5 | 15 |
| 27 | 954 | 828 | 856 | 461 | 815 | 609 | 14.7 | 15.2 | 15.3 |
| 35 | 920 | 742 | 990 | 471 | 831 | 715 | 14.5 | 15.7 | 15.1 |
| 50 | 932 | 831 | 911 | 485 | 832 | 689 | 15 | 15.5 | 15 |

*calcium oxide

As with Example 1, this example demonstrates that emulsions of the present invention, at varying concentrations of insoluble calcium oxide, and using different types of surfactant, exhibit good stability as indicated by the substantially constant viscosity and droplet size.

EXAMPLE 3

This example demonstrates preparation and stability of multiple emulsion in accordance with the invention for emulsions prepared having 1% volume of water droplets in the internal suspension-in-bitumen phase, as compared to the 2% volume of water in Examples 1 and 2. Four sets of emulsions were prepared, two of which were prepared having 1% and 2% vol. of internal water droplets with magnesium oxide in suspension and using as surfactant an ethoxylated nonyl phenol (Intan 100), and another two which were prepared using 1% and 2% water suspension droplets respectively and, as surfactant, ethoxylated alcohol (Intan 200).

The emulsions having 2% volume of water in the suspension-in-bitumen emulsion were prepared as in Example 1 above. The emulsions prepared having 1% water in the inner water droplet suspension phase were prepared as follows:

990 grams of Cerro Negro bitumen were heated at 60° C. in a suitable container for 1 hour. 10 ml of a magnesium oxide suspension were added to the bitumen and mixed for 3 minutes at 1400 rpm. 0.99 grams of a surfactant were dissolved in 49.41 grams of water, and the surfactant/water mixture was added to the suspension-in-bitumen emulsion and mixed with a beater paddle for 3 minutes at 700 rpm so as to provide a suspension-in-bitumen-in-water multiple emulsion having a ratio of bitumen/water of 85/15. To this multiple emulsion, 74.87 grams of additional water were added and mixed at low shear stress for 1 minute so as to provide the desired multiple emulsion having a ratio of bitumen/water of about 70/30.

Table 5 set forth below shows storage characteristics for the 1% and 2% emulsions prepared using ethoxylated nonyl phenol (Intan 100) as surfactant.

TABLE 5

| storage | 1% water droplets Viscosity (20 1/s) mPa | | | | | 2% water droplets Viscosity (20 1/s) mPa | | | | |
|---|---|---|---|---|---|---|---|---|---|---|
| time (days) | 0* (ppm) | 100 (ppm) | 200 (ppm) | 350 (ppm) | D μm | 0* (ppm) | 100 (ppm) | 200 (ppm) | 350 (ppm) | D μm |
| 1 | 1121 | 1005 | 1286 | 1007 | 17.39 | 1026 | 1264 | 918 | 1191 | 17.70 |
| 7 | 1071 | 1128 | 1123 | 991 | 17.13 | 1138 | 1193 | 1104 | 1068 | 17.39 |
| 14 | 1250 | 1390 | 1248 | 1128 | 16.98 | 1446 | 1465 | 1292 | 1167 | 17.20 |
| 21 | 1333 | 1346 | 1089 | 1062 | 17.68 | 1566 | 1312 | 1282 | 1239 | 17.80 |
| 30 | 1370 | 1301 | 1253 | 1121 | 18.19 | 1322 | 1263 | 1262 | 1151 | 17.90 |

*magnesium oxide

Table 6 set forth below shows the storage results and characteristics for the emulsions prepared using ethoxylated alcohol (Intan 200).

TABLE 6

| storage | 1% water droplets Viscosity (20 1/s) mPa | | | | | 2% water droplets Viscosity (20 1/s) mPa | | | | |
|---|---|---|---|---|---|---|---|---|---|---|
| time (days) | 0* (ppm) | 100 (ppm) | 200 (ppm) | 350 (ppm) | D μm | 0* (ppm) | 100 (ppm) | 200 (ppm) | 350 (ppm) | D μm |
| 1 | 1144 | 1359 | 932 | 1025 | 17.89 | 1216 | 1578 | 1512 | 1243 | 17.37 |
| 7 | 1440 | 1329 | 1125 | 1290 | 17.68 | 1217 | 1466 | 1724 | 1430 | 17.75 |
| 14 | 1244 | 1375 | 1149 | 1195 | 18.10 | 1263 | 1434 | 1413 | 1154 | 17.09 |
| 21 | 1254 | 1377 | 1246 | 1088 | 17.92 | 1171 | 1387 | 1342 | 1059 | 17.56 |

*magnesium oxide

As shown, excellent results are provided for all four multiple emulsions prepared in accordance with the present invention.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A stable multiple emulsion, comprising:

a continuous water phase;

an oil droplet phase dispersed through the continuous water phase;

an inner water droplet phase dispersed through the oil droplet phase; and a water insoluble compound suspended in the inner water droplet phase.

2. A multiple emulsion according to claim 1, wherein the water insoluble compound is selected from the group consisting of water insoluble magnesium compounds, water insoluble calcium compounds and mixtures thereof.

3. A multiple emulsion according to claim 2, wherein the water insoluble compound is selected from the group consisting of carbonates, hydroxides, oxides, phosphates and mixtures thereof.

4. A multiple emulsion according to claim 1, wherein the water insoluble compound is selected from the group consisting of magnesium oxide, calcium oxide and mixtures thereof.

5. A multiple emulsion according to claim 1, wherein the water insoluble compound is magnesium oxide.

6. A multiple emulsion according to claim 1, wherein the water insoluble compound is present substantially entirely within the inner water droplet phase.

7. A multiple emulsion according to claim 1, wherein the water insoluble compound is present in the inner water droplet phase in an amount less than or equal to about 500 ppm (wt) based on the total emulsion.

8. A multiple emulsion according to claim 1, wherein the water insoluble compound is present in the inner water droplet phase in an amount between about 100 and about 350 ppm (wt) based on the total emulsion.

9. A multiple emulsion according to claim 1, wherein an interface between the inner water droplet phase and the oil droplet phase of the multiple emulsion is substantially free of added surfactant.

10. A multiple emulsion according to claim 1, wherein the oil droplet phase comprises a viscous hydrocarbon having a viscosity greater than or equal to about 100 cp at 122° F., an API gravity of less than or equal to about 16, and a metal content of at least about 1000 ppm (wt).

11. A multiple emulsion according to claim 10, wherein the viscous hydrocarbon contains vanadium in an amount greater than or equal to about 700 ppm (wt).

12. A multiple emulsion according to claim 1, wherein the emulsion has a ratio by volume of oil to total water in the emulsion of between about 90/10 and about 50/50.

13. A multiple emulsion according to claim 1, wherein the emulsion has a ratio by volume of oil to total water in the emulsion of about 70/30.

14. A multiple emulsion according to claim 1, wherein the inner water droplet phase is less than or equal to about 2% vol. with respect to the multiple emulsion.

15. A multiple emulsion according to claim 1, wherein the continuous water phase is less than or equal to about 28% vol. with respect to the multiple emulsion.

16. A multiple emulsion according to claim 1, wherein the oil droplet phase has an average droplet diameter of between about 10 microns and about 30 microns.

17. A multiple emulsion according to claim 1, wherein the inner water droplet phase has an average droplet diameter of between about 2 microns and about 6 microns.

18. A multiple emulsion according to claim 1, further comprising a surfactant present substantially entirely at an interface between the oil droplet phase and the continuous water phase of the multiple emulsion.

19. A method for forming a stable multiple emulsion, comprising the steps of:

providing a suspension of a water insoluble compound in water;

providing an oil phase;

forming a water in oil emulsion of the suspension in the oil phase;

providing a continuous water phase; and forming a multiple emulsion of the water in oil emulsion in the continuous water phase in the presence of a surfactant.

20. A method according to claim 19, wherein the suspension contains the water insoluble compound in an amount less than or equal to about 12% (wt) with respect to the suspension.

21. A method according to claim 19, wherein the water in oil emulsion has an average water droplet size of between about 2 microns to about 6 microns.

22. A method according to claim 19, wherein the water in oil emulsion has a ratio of oil to water by volume of between about 90/10 and about 98/2.

23. A method according to claim 19, wherein the oil droplet phase has an average droplet diameter of between about 10 microns and about 30 microns.

24. A method according to claim 19, wherein the multiple emulsion has a ratio by volume of oil phase to total water of between about 90/10 and about 50/50.

25. A method according to claim 19, wherein the multiple emulsion has a ratio by volume of oil phase to total water of about 70/30.

26. A method according to claim 19, wherein the step of forming the water in oil emulsion is carried out in the substantial absence of added surfactant.

* * * * *